US007577264B2

(12) United States Patent
Caploon

(10) Patent No.: US 7,577,264 B2
(45) Date of Patent: Aug. 18, 2009

(54) AUDIO RECORDATION AND REPRODUCTION SPRING CLIPS

(75) Inventor: Konstantin A. Caploon, 27 Brookfield Rd., Montclair, NJ (US) 07043

(73) Assignee: Konstantin A. Caploon, Montclair, NJ (US)

( * ) Notice: Subject to any disclaimer, the term of this patent is extended or adjusted under 35 U.S.C. 154(b) by 800 days.

(21) Appl. No.: 10/862,302

(22) Filed: Jun. 7, 2004

(65) Prior Publication Data

US 2005/0271231 A1 Dec. 8, 2005

(51) Int. Cl.
*G09F 27/00* (2006.01)

(52) U.S. Cl. ..... 381/124; 381/334; 24/67.1; 24/67.5; 24/67.9; 24/3.12; 24/3.5; 248/447; 248/689

(58) Field of Classification Search ..... 381/300, 381/333–334, 364, 124, 77–82, 92, 91; 24/67.5, 24/67.1, 67.9, 67.11, 1, 351, 229.13, 3.12, 24/3.1, 3.5, 67; 248/447, 689
See application file for complete search history.

(56) References Cited

U.S. PATENT DOCUMENTS

| | | | | |
|---|---|---|---|---|
| 2,517,181 | A | | 8/1950 | Davis |
| 3,312,475 | A | | 4/1967 | Mazuranic |
| 3,405,944 | A | | 10/1968 | Krechman |
| 3,509,288 | A | | 4/1970 | Leventhal |
| 3,767,206 | A | | 10/1973 | Rehklau et al. |
| 3,870,318 | A | | 3/1975 | Poynter |
| 3,889,290 | A | | 6/1975 | Seaton |
| 3,999,446 | A | | 12/1976 | Louzil et al. |
| 4,100,581 | A | | 7/1978 | Slack et al. |
| 4,102,067 | A | | 7/1978 | Tarrant |
| 4,169,970 | A | | 10/1979 | Opiela et al. |
| 4,222,188 | A | | 9/1980 | Tarrant et al. |
| 4,302,752 | A | | 11/1981 | Weitzler |
| 4,500,019 | A | | 2/1985 | Curley, Jr. |
| 4,541,805 | A | | 9/1985 | Weaver et al. |
| 4,607,747 | A | | 8/1986 | Steiner |
| 4,654,728 | A | * | 3/1987 | Lunsford ..... 360/74.1 |
| 4,715,060 | A | | 12/1987 | Lipscher et al. |
| 4,764,962 | A | | 8/1988 | Ekman et al. |
| 4,791,741 | A | | 12/1988 | Kondo |
| D299,336 | S | | 1/1989 | Osanai et al. |
| 4,828,105 | A | | 5/1989 | Silengo et al. |
| 4,839,749 | A | | 6/1989 | Franklin |
| 4,846,348 | A | | 7/1989 | Smith |
| 4,862,438 | A | | 8/1989 | Fry |
| 4,934,079 | A | | 6/1990 | Hoshi |
| 4,974,759 | A | | 12/1990 | McDonough |
| 4,981,243 | A | | 1/1991 | Rogowski |
| D321,209 | S | | 10/1991 | Hiromori |
| D321,210 | S | | 10/1991 | Hiromori |
| 5,063,698 | A | | 11/1991 | Johnson et al. |
| 5,070,755 | A | | 12/1991 | Carroll |
| 5,114,185 | A | | 5/1992 | Reedom |
| 5,115,472 | A | | 5/1992 | Park et al. |
| 5,166,851 | A | | 11/1992 | Jacobson |

(Continued)

*Primary Examiner*—Vivian Chin
*Assistant Examiner*—Disler Paul
(74) *Attorney, Agent, or Firm*—Harness, Dickey & Pierce P.L.C.

(57) ABSTRACT

Audio recordation and reproduction spring clips of various configurations are disclosed. The clips are adapted to quickly, securely, resiliently, biasedly, and removably attach audio messages to documents, folders, papers, etc., as well as bind objects, such as documents, together.

6 Claims, 10 Drawing Sheets

U.S. PATENT DOCUMENTS

D332,787 S 1/1993 Davis
5,182,872 A 2/1993 Lee et al.
5,241,427 A 8/1993 Lin
5,245,171 A 9/1993 Fox et al.
5,249,336 A 10/1993 Miller
5,275,285 A 1/1994 Clegg
5,277,452 A 1/1994 Skidmore
5,293,273 A 3/1994 Glick
5,293,999 A 3/1994 Linngren
5,294,229 A 3/1994 Hartzell et al.
5,313,557 A 5/1994 Osterhout
5,372,258 A 12/1994 Daneshvar
5,387,108 A 2/1995 Crowell
5,500,987 A 3/1996 Rosen
5,577,918 A 11/1996 Crowell
5,752,335 A 5/1998 Shimogori et al.
5,794,799 A 8/1998 Collins et al.
5,798,686 A 8/1998 Schreiner
5,815,586 A 9/1998 Dobbins
5,829,102 A * 11/1998 Conti ..... 24/3.12
5,890,121 A 3/1999 Borcherding
5,896,624 A 4/1999 Horswell
5,903,869 A 5/1999 Jacobson et al.
5,917,175 A 6/1999 Miller et al.
5,983,182 A 11/1999 Moore
6,021,181 A 2/2000 Miner et al.
6,148,173 A 11/2000 Bell
6,167,233 A 12/2000 Gresser, Jr. et al.
6,226,840 B1 5/2001 Lu
6,259,794 B1 7/2001 Dobbins
6,282,154 B1 8/2001 Webb
6,289,253 B1 9/2001 Lida
6,298,990 B1 10/2001 Amrod et al.
6,325,066 B1 12/2001 Hughes et al.
6,369,698 B1 4/2002 Valente
6,381,338 B1 * 4/2002 Ou ..... 381/365
6,418,283 B1 7/2002 Wegman et al.
6,431,513 B1 8/2002 Rosen
6,473,571 B1 10/2002 Wegman et al.
6,585,154 B1 7/2003 Ostrover et al.
6,690,912 B1 2/2004 Vaughn
6,736,644 B1 5/2004 Vaughn
6,754,934 B1 * 6/2004 Shiffler ..... 16/42 R
2002/0103650 A1 8/2002 Lewis, Jr.
2004/0040122 A1 * 3/2004 Huang ..... 24/67.5
2004/0078203 A1 4/2004 Peter
2004/0218081 A1 * 11/2004 Lohr et al. ..... 348/335
2005/0259524 A1 * 11/2005 Yeh ..... 369/25.01

* cited by examiner

AUDIO RECORDATION AND REPRODUCTION SPRING CLIPS

BACKGROUND OF THE INVENTION

1. Field of the Invention

The present invention relates broadly to audio reproducing attachment devices, and particularly to audio recordation and reproduction circuitry mounted on spring clips to facilitate removable attachment of audio messages to objects such as, for example, papers, folders, documents, and the like.

2. Description of Related Art

The varied uses of removably adhesive papers, or notes, such as Minnesota Mining and Manufacturing Company's (otherwise known as 3M Corporation's) Post-it® brand notes, is well known in the art. In general office practice, for example, an addressor will compose a handwritten message on such a note, adhere the note to a document, and convey the document with the attached note to an intended recipient for action to be taken in accordance with the handwritten message.

Alternatively, such notes may be used as reminders, and adhered to conspicuous places to draw attention to them.

One known drawback to the use of such notes is the amount of time involved in writing down a desired message. Indeed, it takes noticeably more time and effort to write down a 23-word sentence, for example, than it does to say and record it. In professions where time cannot be wasted, and where efficiency concerns exist, this is particularly acutely noticed.

In partially addressing this shortcoming, the general, obvious advantages of recorded audio communication over the written or printed medium are well known. They include the superior ease and speed of dictation (over handwriting or typing) and the opportunity to make a more personal and/or distinct impression on the receiver, by way of vocal inflection, tone of voice, etc.

Audio recording and reproducing devices, the various constructions of which are well known in the art, have been employed for multiple personal and business communication purposes, including for message conveyance, audio mail, audio product promotion and self-reminder systems. Examples of such uses and devices can be found in U.S. Pat. No. 5,577,918 to Crowell and U.S. Pat. No. 5,903,869 to Jacobson et al. Additional non-limited examples of such devices include known hand-held voice recorders, key-chain voice recorders, and voice-recording pens.

For purposes of this disclosure, the terms "audio recordation and playback device", "audio recordation and reproduction circuitry", "voice recorders", any variations thereof, or such similar terms that connote the same meaning, are understood to be the virtually infinitely variable arrangements of physical and electrical circuitry and components, including, but not limited to, the quantity, style and functionality of various buttons, switches, microphones, speakers, light emitting diodes, displays, power sources, and the like, that form such devices, which are well known to those skilled in the art.

The prior art also contains some voice recording and reproduction devices with ancillary attachments adapted to couple the voice recording and reproducing devices to objects. One such exemplary attachment is a pocket clip integrated with a voice-recording pen. The clip allows for the pen to be attached to a user's pocket, or even a document, for example. However, one drawback of this arrangement is the geometry and binding capacity of both the clip itself, and the clip with the pen. It is known that pens with pocket clips are not designed for the same purposes, nor commonly used in the same manners as are paper clips, binder clips, or generally, spring clips, to attach to documents, for example, or bind documents together.

Another exemplary attachment is a key-chain ring connected to a voice-recorder. The key-chain ring allows for attachment of the voice recorder to a set of keys, for example. However, such a key-chain ring and voice-recorder configuration is similarly not designed for, and not intended, nor adapted to be used in the same manner as spring clips.

It is noted that, as used herein, the term "spring clips" generally refers, without limitation, to, known binder clips, paper clips and any variations and configurations thereof that have similar known purposes and functions, and which are adapted to be biasedly attached to objects, and/or hold multiple objects, such as documents, together. The uses and advantages of such spring clips are well known in the art.

It is also noted that the prior art continues to recognize the distinct and separate advantages of reusable adhesive-backed notes, audio recording and reproduction devices, and spring clips, yet predominantly uses each independently of the others.

Thus, it is the combination and utilization of the advantageous features of these three items that has not been realized by the prior art. As such, it is observed that the prior art is deficient in, and that there is a need for, audio recording and reproducing devices that are particularly adapted for removable adherence to objects in the same manner as spring clips, thereby providing the benefits of recorded audio communications together with the configurations, adaptabilities and binding capabilities of spring clips, thus facilitating the attachment of recorded audio messages to documents, for example.

SUMMARY OF THE INVENTION

The present invention addresses various deficiencies recognized in the prior art. Thus, an object of the present invention is to provide audio recording and reproducing devices that are particularly adapted for removable adherence to objects in the same manner as spring clips, thereby providing the benefits of recorded audio communications together with the configurations, adaptabilities and binding capabilities of spring clips.

The present invention therefore enables a user to easily record a desired audio message onto a device, and securely and removably attach the device to a desired object, such as a document.

The virtually infinitely variable arrangements of physical and electrical circuitry and components, including the quantity, style and functionality of various buttons, switches, microphones, speakers, light emitting diodes, displays, power sources, and the like, to form an audio recording and reproducing device, are well known to those skilled in the art. Similarly, the many various arrangements of spring clips are also well known to those skilled in the art. Accordingly, it is sufficient for adequate disclosure of the present invention to understand and appreciate that such circuitry and components may be adapted in various ways to various spring clips in accordance with aspects of the present invention.

Thus, one object of the present invention is to provide audio circuitry attached to a spring clip, wherein the audio circuitry facilitates audio recordation and playback, and includes a microphone, speaker, memory, message indicator light, power source, and a controller having various switches and buttons such as a toggle switch and actuation button. The spring clip comprises a first side having a first end and a first fulcrum portion, a second side having a second end and a second fulcrum portion, a fulcrum joining the first and second sides at the first and second fulcrum portions, the first and second ends being below the fulcrum and resiliently biased toward each other, a first actuating arm associated with said first side and extending above the fulcrum, and a second actuating arm associated with the second side and extending above the fulcrum, wherein the urging of the first and second actuating arms toward each other causes the urging of the first and second ends away from each other.

Another object of the present invention is to have the first and second arms of the spring clip, as described above, extend below the fulcrum.

Additionally, at least a portion of the audio circuitry may be connected to the first actuating arm of the spring clip, or to the fulcrum.

Still another object of the present invention is to have an audio circuit that is attached to a housing which is secured to the first actuating arm of the spring clip. This housing may be permanently secured to the actuating arm, or alternatively, may be removably secured thereto.

Yet another object of the present invention is to provide audio circuitry attached to a spring clip which comprises a unitary wire bent to form at least two sections that are resiliently biased toward each other so as to facilitate compressively straddling an object that is wedged in between the two sections. Such spring clip may comprise two, three, four, or more bends, and the bends may be more than 90 or even more than 180 degrees each. Additionally, the audio circuitry may be attached to a housing which is secured to one of the at least two sections of the spring clip.

Another object of the present invention is to provide audio circuitry attached to a spring clip which comprises a unitary and substantially planar binder having a bridge with two ends that are resiliently biased toward being in a common plane such that when an object is wedged between the two ends, the two ends compressively straddle the object. Additionally, the spring clip may be configured to be in the shape of an ampersand, or an arrow, for example, and the circuitry may be attached to a housing which is secured to one of the two ends of the spring clip.

Additional objects and advantages of the invention are set forth in, or will be apparent to those of ordinary skill in the art from, the detailed description herein. Also, it should be further appreciated that modifications and variations to the specifically illustrated and disclosed features or materials or devices hereof may be practiced in various embodiments and uses of this invention without departing from the spirit and scope thereof, by virtue of present reference thereto. Such variations may include, but are not limited to, substitution of equivalent arrangements, features and/or materials for those shown or discussed, and the functional or positional reversal of various parts or features or the like. Still further, it is to be understood that different embodiments, as well as different presently preferred embodiments, of this invention may include various combinations or configurations of presently disclosed features or elements or their equivalents (including combinations of features or configurations thereof not expressly shown in the figures or stated in the detailed description).

BRIEF DESCRIPTION OF THE DRAWINGS

A full and enabling disclosure of the present invention, including the best mode thereof, directed to one of ordinary skill in the art, is set forth in the specification, which makes reference to the appended figures, where similar reference characters denote similar elements throughout the several views.

FIG. 13 is a perspective and side cut-away view of a prior art portable message device with a hook shaped attachment means for detachable attachment to the closure of automobiles, buildings, and the like.

DETAILED DESCRIPTION

Figure 3:
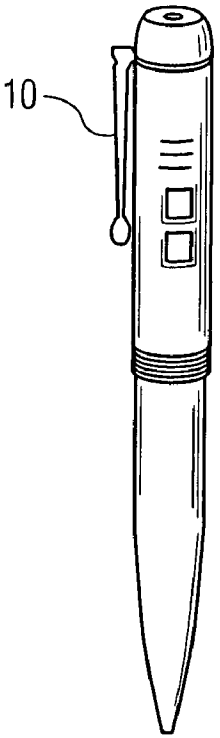
FIG. 3 PRIOR ART
FIG. 3 is a perspective view of a prior art audio recorder and playback pen with a pocket clip attached thereto.
Figure 2:
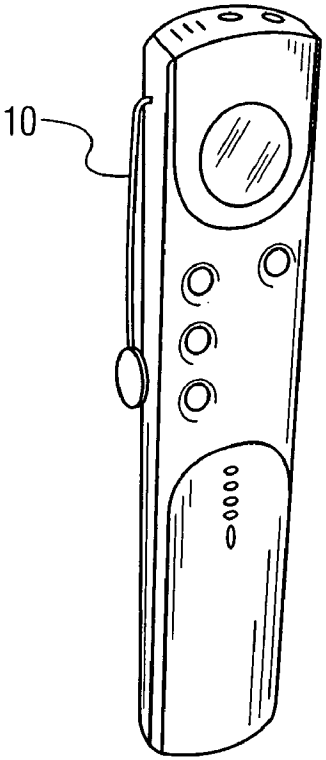
FIG. 2 PRIOR ART
FIG. 2 is a perspective view of a prior art hand-held audio recorder and playback device with a pocket clip attached at one side.
Figure 1:
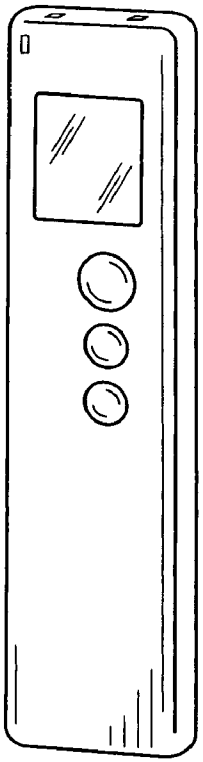
FIG. 1 PRIOR ART
FIG. 1 is a perspective view of a prior art hand-held audio recorder and playback device.

In FIGS. 1-5, there are depicted various prior art audio recordation and reproduction devices. Some of these devices, such as the voice recorder of FIG. 1, appear to only have one purpose, which is to facilitate voice recordation and playback. Alternatively, the voice recorders of FIGS. 2 and 3 also include a pocket clip 10. Notably, the voice recorder of FIG. 3 is in the shape of a pen, and is a writing utensil.

As is well known in the art, clip 10 is commonly found on writing utensils such as pens, and facilitates attaching a pen to a person's pocket, for example. It is also possible to attach the pen, via clip 10, to a document, or the like. However, unlike spring clips, this is not known to be a reliable way of attaching an object, such as pen, to a document, nor a reliable way of holding more than one document together. Particularly in the case of the voice-recorder of FIG. 2, or the voice-recording pen of FIG. 3, clip 10 would not be used like a spring clip to rely on securely attaching the voice recorders to documents, for example, or binding several documents together. At least one evident reason for this is the known geometry, binding capacity, and awkwardness of clip 10 in combination with the voice-recorders of FIGS. 2 and 3. This awkwardness is not adaptable to mimicking the functionality or reliability of a spring clip in binding to articles, or binding articles together.

Figure 4:
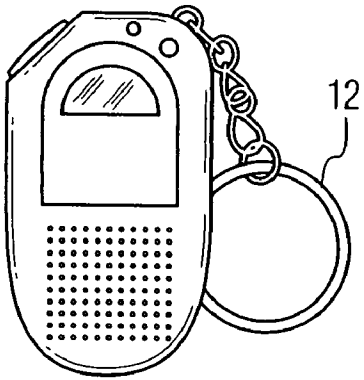
FIG. 4 PRIOR ART
FIG. 4 is a perspective view of a prior art audio recorder and playback key-chain attachment with a key-chain ring.

FIG. 4 depicts a prior art voice-recording key-chain with an attached key ring 12 for keys. Again, neither this embodiment of the voice recorder, nor its combination with a key ring 12, is adapted to act or be used like a spring clip in binding to an article, or binding articles together.

Figure 5:
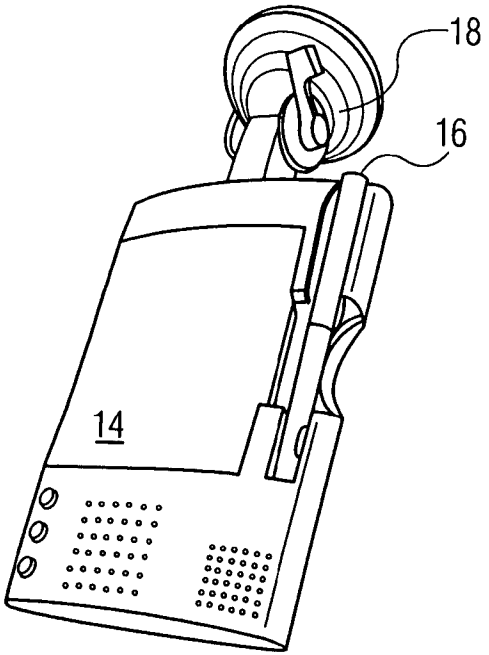
FIG. 5 PRIOR ART
FIG. 5 is a perspective view of a prior art apparatus adapted to be attached to a surface via suction-cup action, the apparatus incorporating a writing utensil and adhesive-backed notes holder, as well as incorporating an audio recorder and playback device.
Figure 6:
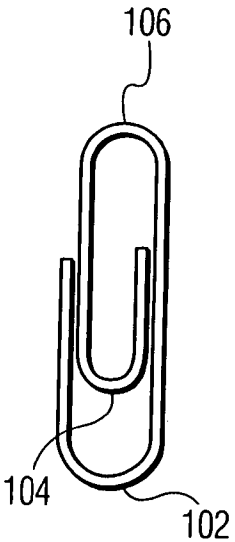
FIG. 6 PRIOR ART
FIG. 6 is a frontal view of one prior art embodiment of a commonly known, unitary construction, wire paper clip having three bends.
Figure 7:
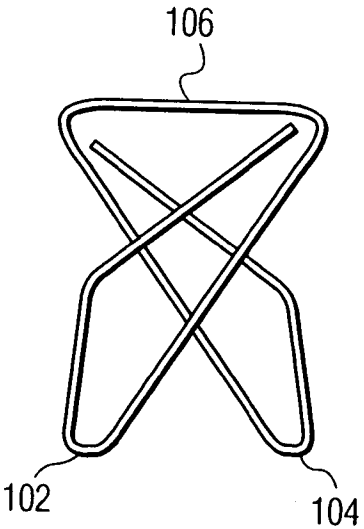
FIG. 7 PRIOR ART
FIG. 7 is a frontal view of another prior art embodiment of a commonly known, unitary construction, wire paper clip having six bends.
Figure 8:
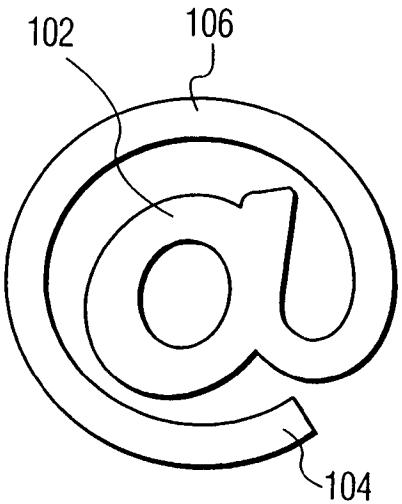
FIG. 8 PRIOR ART
FIG. 8 is a frontal view of yet another prior art embodiment of a commonly known, unitary construction, paper clip in the form of an ampersand.

FIG. 5 depicts a prior art voice-recording unit that houses adhesively backed notes 14 and a writing utensil 16. This unit is adapted to adhere to a surface via a suction cup 18. Once again, this unit does not possess the functionality of a spring clip.

FIGS. 6-9 are commonly known prior art embodiments of variously sized and shaped paper clips. As is well known in the art, these clips are resiliently and biasedly bound to articles, such as paper, and are adapted to hold articles, such as two or more documents, together. It is observed that in the prior art, these clips have not been outfitted with voice-recording units. A fuller discussion of the geometric and mechanical aspects of these clips will be provided, below, with reference to FIGS. 25-28.

Figure 10:
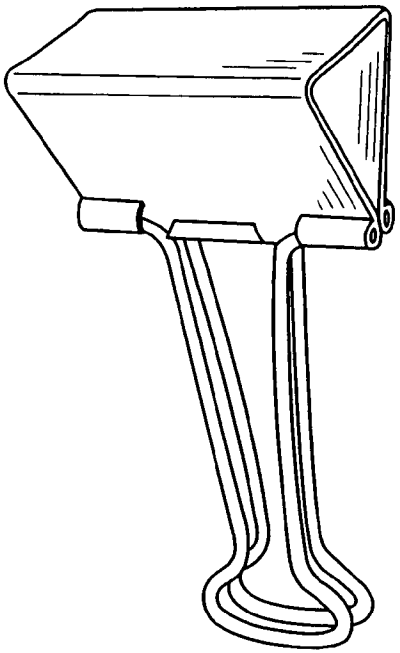
FIG. 10 PRIOR ART
FIG. 10 is a perspective view of a prior art embodiment of a commonly known binder clip having a bite portion, a fulcrum, and rotatably attached lever arms that facilitate opening the bite portion and biasedly seating the clip on an object, such as a document.
Figure 9:
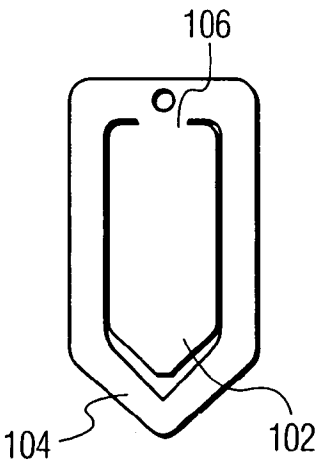
FIG. 9 PRIOR ART
FIG. 9 is a frontal view of yet another prior art embodiment of a commonly known, unitary construction, paper clip in the form of an arrow.

FIG. 10 depicts a commonly known prior art binder clip. Such binder clips are in the same category with the paper clips of FIGS. 6-9 in that they are designed, intended, and adapted to be securedly, resiliently, and biasedly attached to articles, and hold multiple articles together. Once again, it is observed that in the prior art, such clips have not been outfitted with voice-recording units. A fuller discussion of the geometric and mechanical aspects of binder clips will be provided, below, with reference to FIGS. 17-24.

Figure 11:
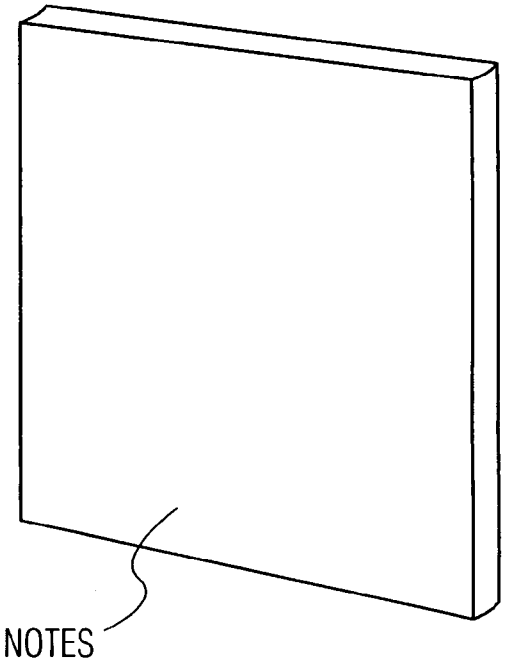
FIG. 11 PRIOR ART
FIG. 11 is a perspective view of a prior art embodiment of commonly known adhesively backed paper notes.
Figure 12:
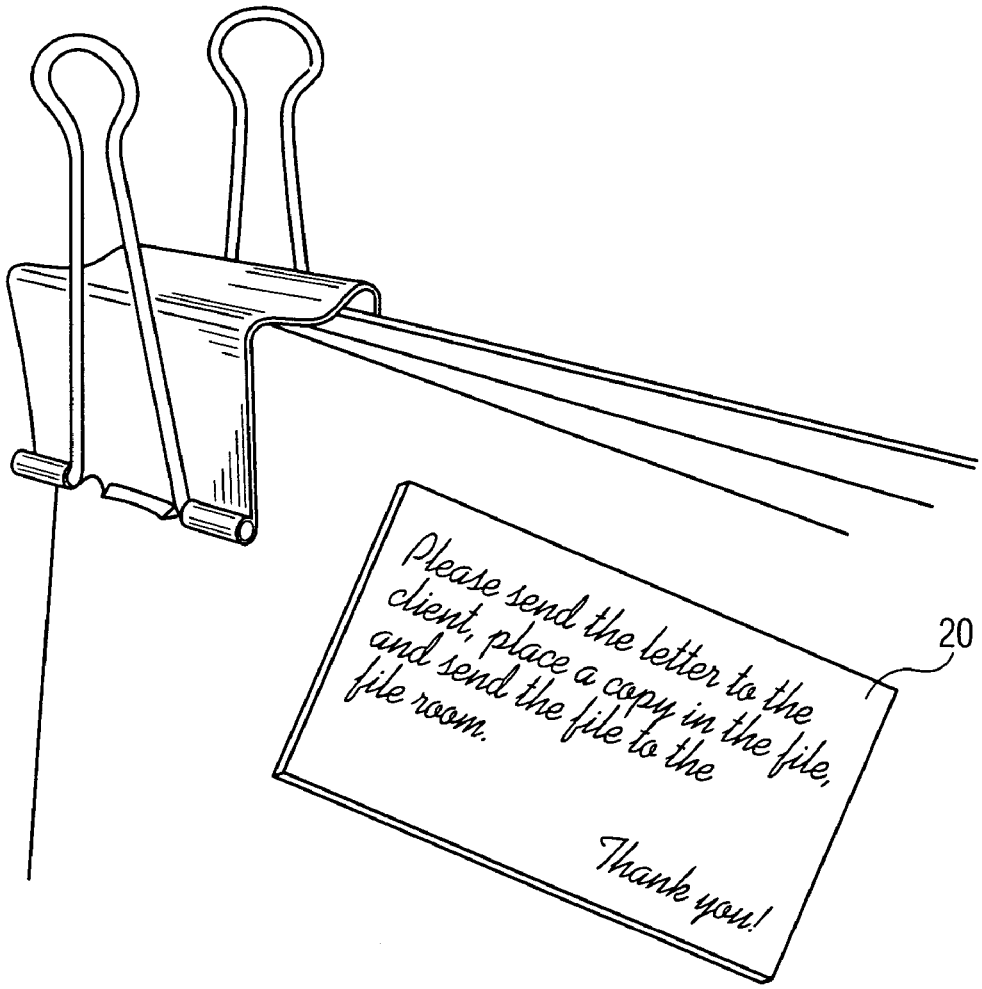
FIG. 12 PRIOR ART
FIG. 12 is a perspective view of a prior art arrangement of documents held together by a binder clip, and an adhesively backed note containing a hand-written message, adhered to the front document, to provide instructions to the recipient of the bound documents.

FIG. 11 depicts commonly known adhesively backed paper notes. As discussed above, among other uses, these notes are used to convey written messages between people. It is readily observed that the time and effort in writing a sentence, versus saying and recording it, may be quite significantly different. For example, reference is made to FIG. 12, where an adhesively backed note 20 containing written instructions is adhered to a document bound to other documents by a common binder clip similar to one depicted in FIG. 10. It is readily recognized that composing the message on note 20, particularly in legible penmanship, may take approximately 30 seconds, while saying and recording the same message onto a voice recorder may take approximately 5 seconds, and with no writing effort. The time and effort differences being apparent, the prior art has not provided any meaningful ways in which to securely, resiliently and biasedly attach such a recorded voice message to a document so as to substitute or supplement note 20.

Figure 13:
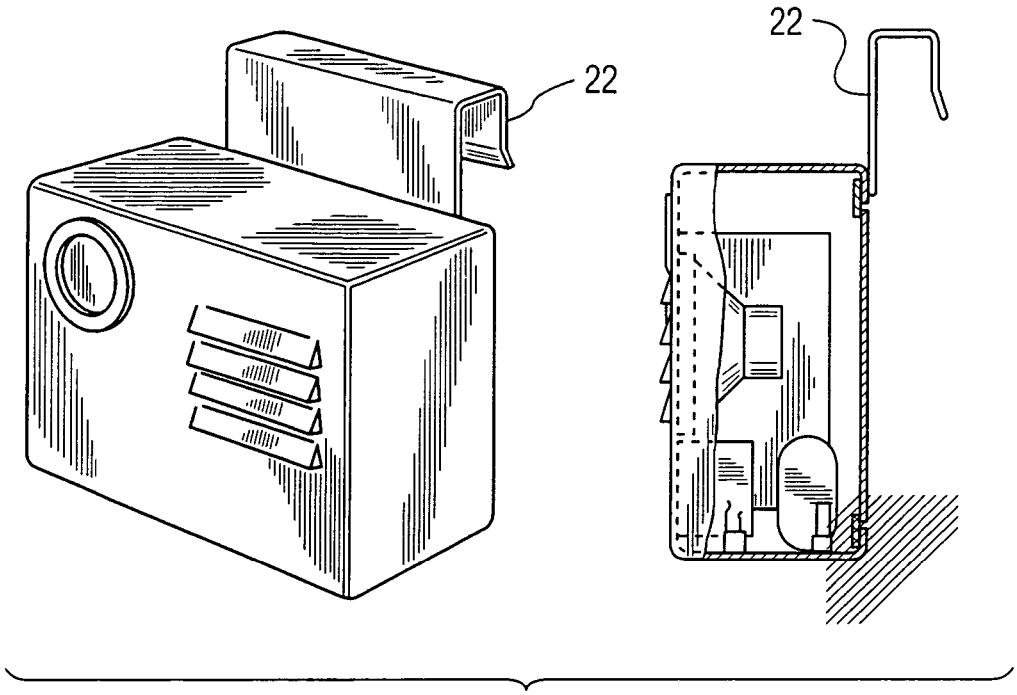
FIG. 13 PRIOR ART

To that extent, with reference to FIG. 13, a prior art portable message device with a hook shaped attachment means for detachable attachment to the closure of automobiles, buildings, and the like is disclosed. In conjunction with this device, there is no recognition of the need for attaching a voice message to a document, as outlined herein. In part, evidence of this is the wide square profile U-shaped hook 22 that is adapted to hang on large objects as described above.

Figure 14:
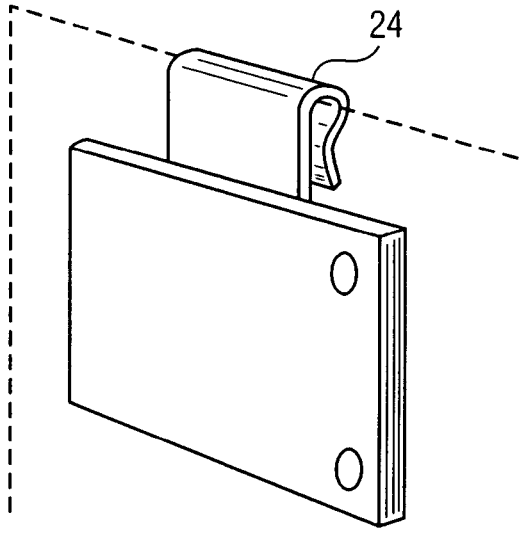
FIG. 14 PRIOR ART
FIG. 14 is a perspective view of a prior art audible message delivery system incorporating a clip for enabling the message delivery system to be supportingly retained on the edge of an object.

FIG. 14 also discloses a prior art portable message device which is adapted to be attached to various surfaces. However, the configuration of the attachment arm 24 is much like that of the device of FIG. 13, and functionally more closely approximates the pocket clip 10 than any of the binder clips discussed previously. Once again, as compared to spring clips, the shortcomings of such an attachment arm to bind the voice recorder to an article, such as a document, or bind several documents together, is apparent.

Figure 15:
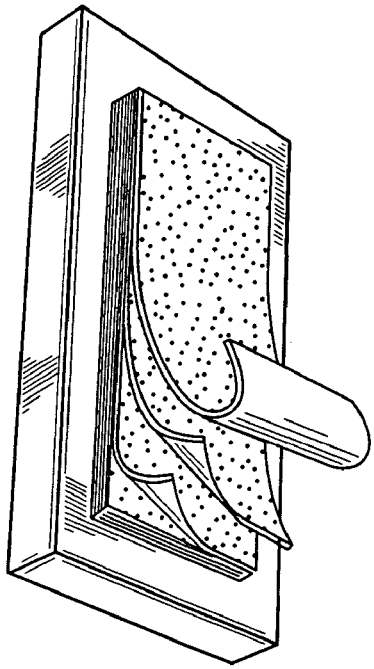
FIG. 15 PRIOR ART
FIG. 15 is a perspective view of a prior art audible message delivery system having a plurality of adhesive stickers attached to the rear of the device to facilitate adhering the device to surfaces.
Figure 16:
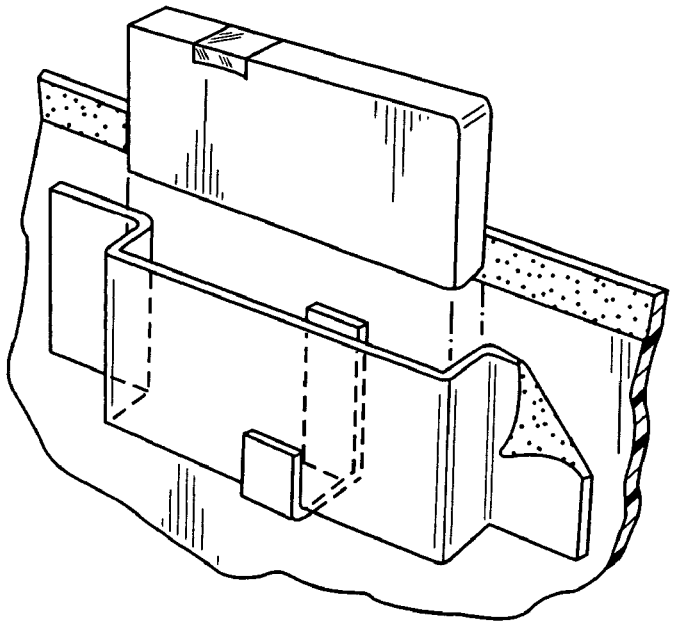
FIG. 16 PRIOR ART
FIG. 16 is a perspective view of a prior art audible message delivery system comprising a holder adhesively secured to a folder, and having a pocket to receive an audible message device.

Similarly, FIGS. 15 and 16 disclose prior art embodiments of various attempts to attach a voice recorder to a document. As evidenced by these figures, although perhaps having some specific useful advantages, the shortcomings of these efforts are that they do not provide a secure, resilient, reliable, reusable mode of directly attaching a voice recording to a document or documents.

Figure 17:
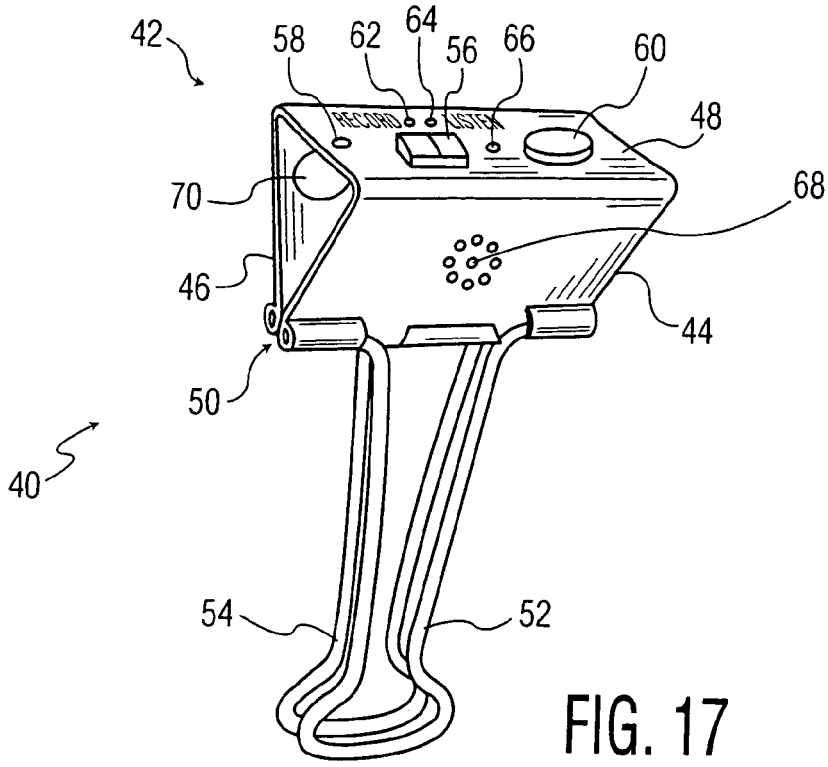
FIG. 17 is a perspective view of a preferred embodiment of the present invention, comprising audio recordation and reproduction circuitry mounted to the binder clip of FIG. 10.

FIG. 17 depicts a preferred embodiment of the present invention. More particularly, a binder clip, such as one well known in the art and disclosed in FIG. 10, is combined with audio recordation and playback circuitry and elements. The combined voice-recording clip ("VRC" for short) is identified as 40. For simplicity, and as discussed previously, with regard to the audio configurations, circuits, capabilities and elements of the audio recordation and playback device incorporated into the VRC, it shall enjoy the same broad definitions and understandings as given to previously outlined terms such as "audio recordation and reproduction circuitry" and "voice recorders".

The VRC 40 has a binder clip body 42 with a substantially triangular shape. Body 42 has a first side 44, a second side 46, and a third side, or fulcrum, 48. By virtue of this well-known configuration, the ends of sides 44 and 46 opposite the fulcrum 48 are resiliently biased toward each other, and form a pincher portion 50. Additionally, first and second actuating arms (otherwise interchangeably referred to as extension or lever arms) 52 and 54, are attached to first and second sides 44 and 46 of the body 42, respectively.

The functionality of such binder clips is well known in the art, and revolves around having first and second actuating arms 52 and 54 above fulcrum 48 in order to provide levers upon which to exert a compressive force. When first and second actuating arms 52 and 54 are raised above fulcrum 48, the urging of arms 52 and 54 toward each other translates over fulcrum 48 to urge the ends of sides 44 and 46, respectively, at the pincher portion 50, to separate. While separated, the VRC 40 may be attached to a document, or multiple documents, or other articles of interest. Once done so, the urging of arms 52 and 54 toward each other may be ceased, thus yielding to, and resulting in, a compressive force exerted in the pincher portion 50 of clip body 42, facilitating the secure attachment of the VRC 40 to the article(s) to which it is attached.

The VRC 40 has a toggle switch 56 mounted on the third side 48, which can be moved between a recording position 62 and a listening position 64. Additionally, mounted on the third side 48 are a microphone 58, actuator button 60, and a message indicator light 66. A speaker 68 is mounted on the first side 44 of the clip body 42, and a power source 70 is mounted on the second side 46.

In order to record an audio message, toggle switch 56 is first moved to the recording position 62. Then actuator button 60 is depressed and a voice message may be recorded onto the VRC 40 via microphone 58. Once recorded, message indicator light 66 indicates that a message is present in the VRC 40.

In order to listen to the message, the toggle switch 56 is moved to the listening position 64. Then actuator button 60 is depressed, and the message will be projected through speaker 68.

The original message may be rerecorded by simply following the steps for recording a message. A power source 70 is mounted to the second side 46 of clip body 42 to provide power to the circuit for accomplishing these outlined tasks.

Figure 18:
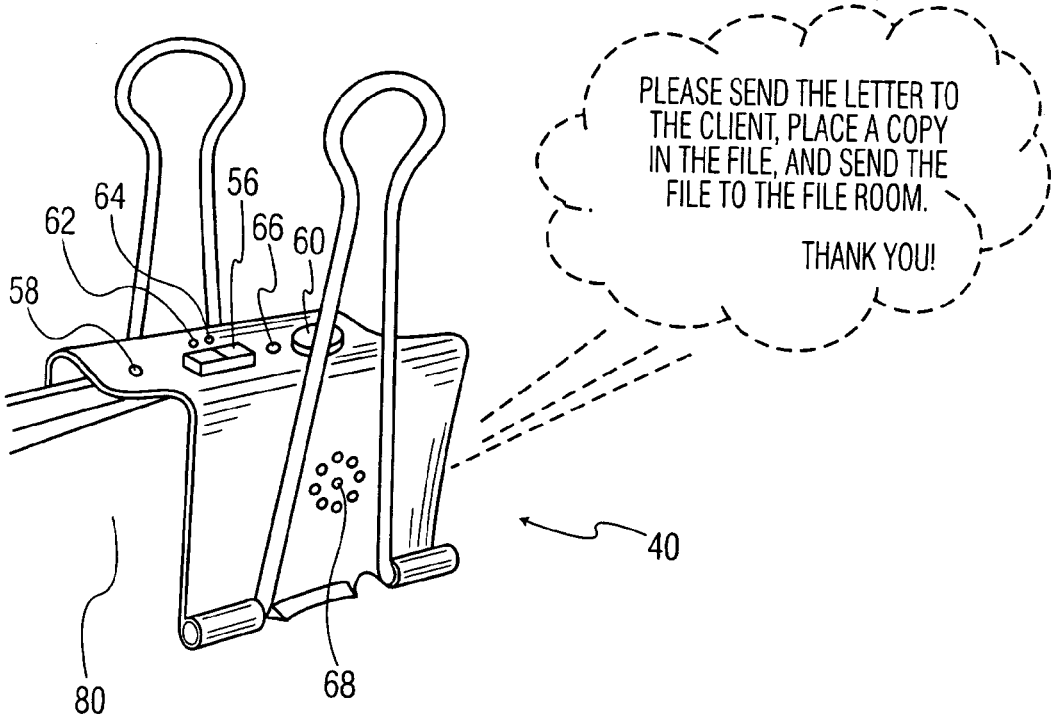
FIG. 18 is a perspective view of a preferred arrangement of the preferred embodiment of the present invention attached to documents, and depicted to be playing a prerecorded audio message providing instructions to a recipient.

Referring to FIG. 18, regardless of the order of the voice message being recorded first, or the VRC 40 first being clipped onto a document or set of documents 80 and then the voice message recorded onto it, the VRC 40 accomplishes the secure, resiliently biased attachment of a recorded voice message to a document or set of documents 80. Additionally, when the actuation button 60 is depressed, the audible message that would have taken approximately 30 seconds to write on an adhesive-backed note, will be heard through speaker 68 in the approximately five seconds that it took to say it.

Figure 19:
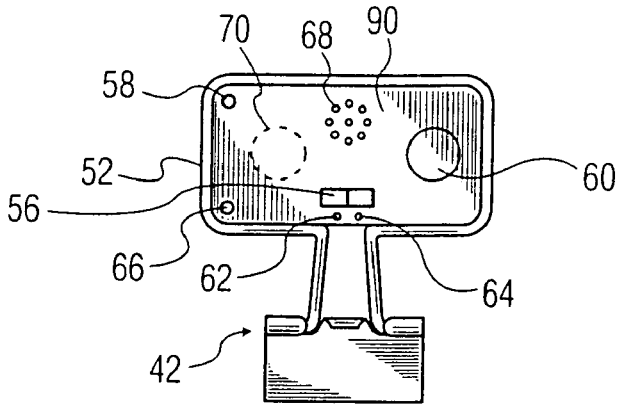
FIG. 19 is a frontal view of another embodiment of the present invention wherein a substantially rectangular shaped audio recordation and playback device is attached to one of the lever arms of a binder clip.

Alternate embodiments of the present invention are depicted in FIGS. 19-22, and 25-28. In FIG. 19, the first actuating arm 52 is configured to contain a housing 90 that supports the electronics of the voice recordation and playback device. Accordingly, the toggle switch 56, with its recording position 62 and listening position 64, as well as the microphone 58, actuator button 60, message indicator light 66, speaker 68, and power source 70 (hidden), are shown on housing 90.

The functioning of these elements, in combination with the functioning of this embodiment of the invention, is similar to that of the preferred embodiment, which has already been described. The difference in the embodiments between the existence, location and shape of the housing 90 supporting the electronics of the voice recordation and playback device is obvious to those skilled in the art, and so need not be further described in detail herein.

Figure 20:
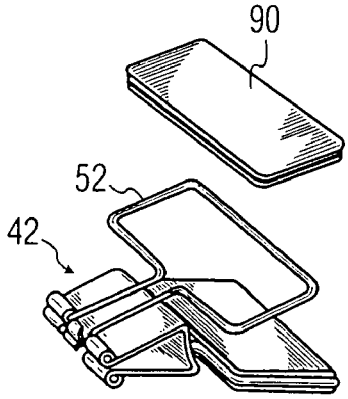
FIG. 20 is a disassembled perspective view of FIG. 19.
Figure 21:
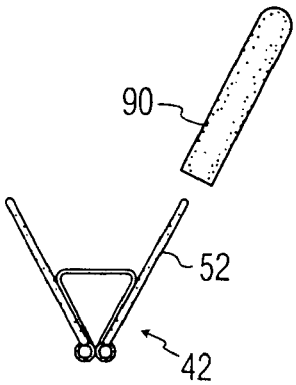
FIG. 21 is a disassembled perspective view of another embodiment of the present invention wherein the audio recordation and playback device is adapted to fit over one of the lever arms of a binder clip.
Figure 22:
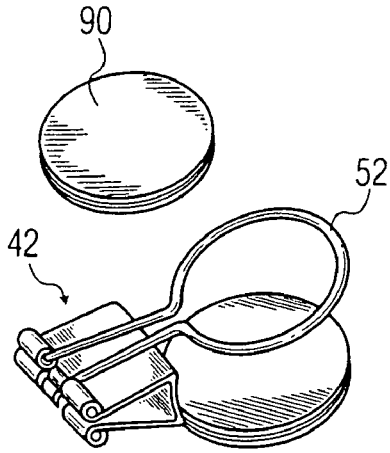
FIG. 22 is yet another embodiment of the present invention wherein a rounded-shaped audio recordation and playback device is attached to one of the lever arms of a binder clip.

Similarly, for simplicity, with reference to alternate embodiments of the present invention as depicted in FIGS. 20-22, as well as all subsequent Figures and embodiments containing housing 90, it is to be understood that housing 90 supports the electronics of the voice recordation and playback device, as described supra.

Another alternate embodiment of the present invention is depicted in FIG. 20 where housing 90 is rectangular in shape, and removably attached to actuating arm 52.

Yet another alternate embodiment of the present invention is depicted in FIG. 21 where housing 90 is configured to attach to the first actuating arm 52 by snugly slipping over it.

Still another alternate embodiment of the present invention is depicted in FIG. 22 where housing 90 is circular in shape, and removably attached to actuating arm 52.

Figure 23:
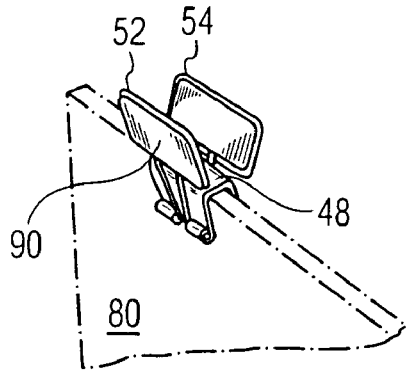
FIG. 23 is a perspective view of an arrangement of the embodiment of FIGS. 19 and 20 attached to a document, where the binder clip has its lever arms extending above the binder clip's fulcrum.
Figure 24:
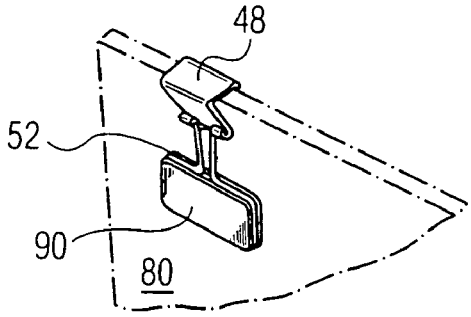
FIG. 24 is a perspective view similar to that of FIG. 23, except the binder clip has its lever arms extending below the binder clip's fulcrum.

FIGS. 23 and 24 depict the alternate embodiment of either FIGS. 19 or 20 in use.

FIGS. 25-28 present more alternate embodiments of the present invention. In these embodiments, housing 90 is understood to be similar to what was described previously although having different shapes, as shown. Additionally, these paper clip-type embodiments of the present invention differ from those of the previously discussed binder clip-type in the known mechanical, structural and kinematic differences that exist between paper clips and binder clips. Namely, paper clips, such as those depicted in FIGS. 6-9, typically are of unitary construction, and have a first end 102, a second end 104, and a bridge 106 linking the first and second ends 102 and 104 together. These clips are arranged so that the bridge 106 resiliently biases the first and second ends 102 and 104 toward being in a common geometric plane, such that when an object is wedged between the two ends 102 and 104, the ends 102 and 104 compressively straddle the object. This behavior is well known to those skilled in the art.

Figure 25:
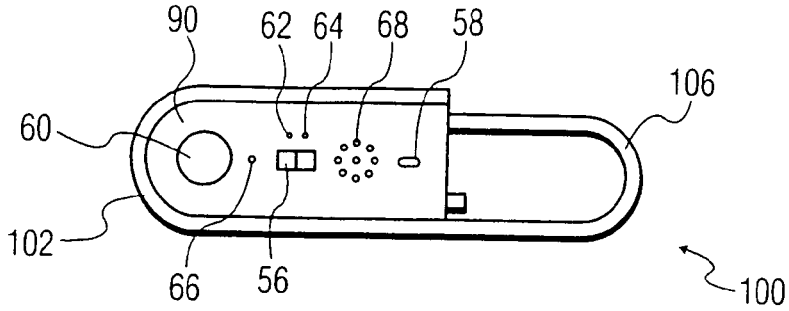
FIG. 25 is a perspective view of an embodiment of the present invention wherein audio recordation and reproduction circuitry is mounted to the paper clip of FIG. 6.
Figure 26:
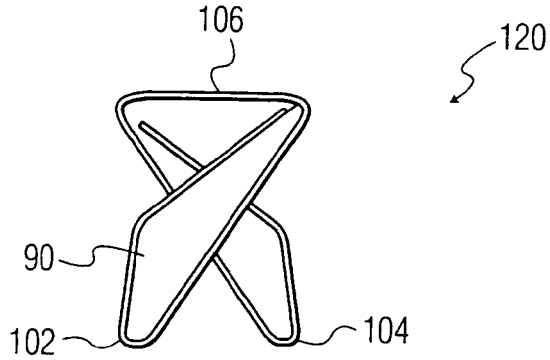
FIG. 26 is a perspective view of yet another embodiment of the present invention wherein audio recordation and reproduction circuitry is mounted to a paper clip of FIG. 7.

With particular reference to FIGS. 25 and 26, one distinguishing feature of these embodiments is that the unitary wire voice recording clips (VRC) 100 and 120 have multiple bends in them. Notably, VRC 100 has three substantially 180-degree bends, while VRC 120 has six bends of varying degrees. These bends are more clearly visible in the prior art clips of FIGS. 6 and 7. Additionally, it is observed that the first and second ends 102 and 104, although urged toward each other by bridge 106, are not in the same plane with each other, but are rather, one on top of another.

Figure 27:
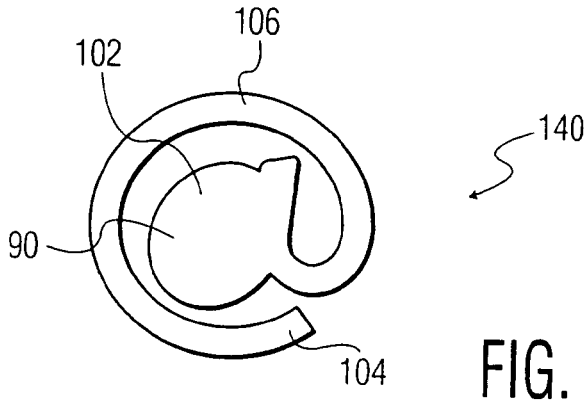
FIG. 27 is a perspective view of yet another embodiment of the present invention wherein audio recordation and reproduction circuitry is mounted to a paper clip of FIG. 8.
Figure 28:
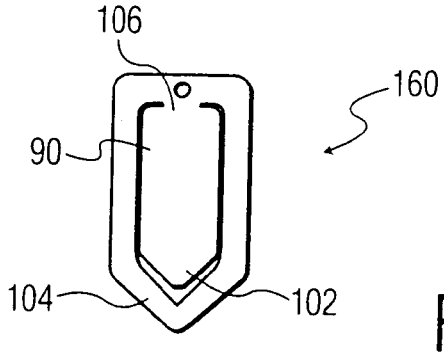
FIG. 28 is a perspective view of yet another embodiment of the present invention wherein audio recordation and reproduction circuitry is mounted to a paper clip of FIG. 9.

Alternatively, with reference to FIGS. 27 and 28, one distinguishing feature of VRCs 140 and 160, is that the two ends 102 and 104 are located in substantially the same plane when the clips are not straddling an object.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims

The invention claimed is:

1. An audio reproducing attachment device, comprising:

audio circuitry attached to a spring clip; wherein said audio circuitry comprises a microphone, a speaker, a controller and a memory, and is configured to facilitate audio recordation and playback; and said spring clip comprises a first side having a first end and a first fulcrum portion, a second side having a second end and a second fulcrum portion, a fulcrum joining said first and second sides at said first and second fulcrum portions, said first and second ends being below said fulcrum and resiliently biased toward each other, a first actuating arm associated with said first side and extending above said fulcrum, and a second actuating arm associated with said second side and extending above said fulcrum, wherein the urging of said first and second actuating arms toward each other causes the urging of said first and second ends away from each other, and wherein at least a portion of said circuitry is physically coupled to said fulcrum.

2. The audio reproducing attachment device of claim 1, wherein the controller comprises a toggle switch and an actuation button.

3. The audio reproducing attachment device of claim 1, wherein said first and second actuating arms may be moved to extend below said fulcrum.

4. The audio reproducing attachment device of claim 1, wherein at least a portion of said audio circuitry is connected to said first actuating arm.

5. The audio reproducing attachment device of claim 1, wherein said audio circuitry is attached to a housing which is secured to said first actuating arm.

6. The audio reproducing attachment device of claim 5, wherein said housing is removably secured to said first actuating arm.

* * * * *

UNITED STATES PATENT AND TRADEMARK OFFICE

CERTIFICATE OF CORRECTION

PATENT NO. : 7,577,264 B2
APPLICATION NO. : 10/862302
DATED : August 18, 2009
INVENTOR(S) : Konstantin A. Caploon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1441 days.

Signed and Sealed this

Seventh Day of September, 2010

David J. Kappos

David J. Kappos
*Director of the United States Patent and Trademark Office*